United States Patent [19]

Ng

[11] 4,197,666

[45] Apr. 15, 1980

[54] DUAL CALIBER REVOLVER

[75] Inventor: Gim S. Ng, Newport News, Va.

[73] Assignee: The United States of America as represented by the Secretary of the Army, Washington, D.C.

[21] Appl. No.: 899,772

[22] Filed: Apr. 24, 1978

[51] Int. Cl.[2] ..... F41C 1/00

[52] U.S. Cl. ..... 42/59

[58] Field of Search ..... 42/65, 59, 69 R

[56] References Cited

U.S. PATENT DOCUMENTS

| | | | |
|---|---|---|---|
| 235,240 | 12/1880 | Hood | 42/65 |
| 467,558 | 1/1892 | Von Pecker | 42/59 |
| 627,966 | 7/1899 | Behr | 42/59 |
| 943,819 | 12/1909 | Du Bose | 42/59 |
| 990,669 | 4/1911 | Rodehaver | 42/59 |
| 1,042,145 | 10/1912 | Rodehaver | 42/59 |
| 3,093,922 | 6/1963 | Ivy | 42/59 |
| 4,041,633 | 8/1977 | Scrufari | 42/59 |

*Primary Examiner*—Charles T. Jordan

*Attorney, Agent, or Firm*—Nathan Edelberg; Robert P. Gibson; Norman L. Wilson, Jr.

[57] ABSTRACT

The benefits of a dual caliber gun have been set forth in various periodicals. Dual caliber revolvers come into consideration as training weapons. Dual caliber revolvers are also important in survival situations, for example downed aircraft or lost hunters. Prior art dual caliber pistons have one barrel below the other one. Such guns possess an inherent accuracy disadvantage. In addition the internal mechanisms of the guns differ so drastically from standard guns that manufacture is expensive and reliability questionable. A more reliable dual caliber gun is provided herein which has a single trigger, normal spring action, and an unmodified firing mechanism.

1 Claim, 5 Drawing Figures

FIG. I.

DUAL CALIBER REVOLVER

BACKGROUND OF THE INVENTION

This invention pertains to double-barrel, dual caliber, firearms.

The benefits of a dual caliber gun have been set forth in various periodicals. It has been found that such guns are useful when camping in areas where there are dangers from both large and small animals. A large caliber gun is needed in case of large animals such as bears. In the case of small creatures such as rats or snakes a small caliber gun is preferred. Dual caliber revolvers are even more important in survival situations, for example downed aircraft or lost hunters. In such circumstances it is important to have a revolver because it can be easily carried, and a dual caliber revolver can be used not only for defensive purposes, but for hunting both small and large animals. A small caliber gun is best for hunting small game such as rabbits and squirrels, whereas, a large caliber gun can be used for hunting larger animals such as deer. Using shotshell cartridges, the large caliber gun can also be used for hunting flying animals such as quail. Since the gun will fire two different sized cartridges, it is not rendered useless if only one size cartridge is available.

Dual caliber revolvers also come into consideration as training weapons. Since it is easier for beginners to master smaller caliber pistols with less recoil than the military 45 caliber automatics, it is not uncommon in handgun training to start troops firing smaller caliber pistols. As a result their training is more thorough and the transition to higher caliber handguns is easier and faster. The dual caliber gun of this invention would cost very little more to manufacture than the single gun, and hence would be a practical approach to the two gun training system.

Double barrel guns firing two sizes of cartridges are described in the prior art in such references as *Guns & Ammo,* June, 1975, p 42, and U.S. Pat. Nos. 943,819, 990,669 and 1,042,145. However each of these guns is subject to certain disadvantages. In the revolver shown in U.S. Pat. No. 943,819 the larger caliber chamber must be empty when the smaller caliber cartridge is fired. If all the chambers are loaded, the gun will fire both its large and small cartridges. Moreover, since the firing pins are not identical, uneven percussion of small and large caliber cartridges is quite likely, rendering the gun unreliable. On impact one cartridge can absorb most of the energy so that the other cartridge may not fire. There is also the disadvantage of having to unload to shoot small game. In that case, survival capability is sacrificed, defeating a purpose of the gun.

The design in U.S. Pat. No. 990,669 is subject not only to the complexities involved in two triggers, but also to a complex cocking mechanism. In order to change cartridge selections, the operator must cock the hammer only halfway, turning the cylinder one-twelfth of its revolution. However to determine whether to fully cock the hammer, or to half-cock it, he must ascertain which chamber is in use. It is not seen how this can be done without the user looking in the cylinder with the gun pointed toward him.

In U.S. Pat. No. 1,042,145 we see an unreliable tappet-hammer design. Because of the small distance between the point of impact and the point of rotation or fulcrum of the tappet, much of the impact energy is transferred to the fulcrum. Therefore, an extremely strong mainspring is required in order for the gun to function properly. This however renders trigger pull difficult, and accelerates wear of the mechanism which absorbs the heavy blow of the hammer.

All of these prior art pistols have one barrel below the other one. If the barrels are far apart as they are in the gun shown in *Guns & Ammo,* the gun possesses an inherent accuracy disadvantage. A slight rotation of the operator's hand will deliver the shot to the left or right of the point sighted over the upper barrel. In addition, as pointed out in the *Guns & Ammo* article the lockwork of the gun has been extensively changed. This is true of all of the prior art guns. They differ so drastically from standard guns that manufacture would be expensive and reliability questionable.

In accordance with this invention a more reliable dual caliber gun is provided which has a single trigger and normal spring action. Moreover the firing mechanism of the gun is unchanged from its normally manufactured single caliber counterpart.

SUMMARY OF THE INVENTION

It is understood that this invention pertains to a known dual caliber revolver of the type having a frame and two barrels attached thereto. A cylinder is carried by the frame with two sizes of cartridge chambers therein, and a firing hammer is mounted within the frame. Means are provided for actuating said firing hammer. By the practice of this invention the known dual caliber revolver is improved by means for supporting the two barrels so that one is beside the other. The cylinder has the two sizes of cartridge chambers alternately concentrically arranged and adjacently aligned to register with their respective barrels. In addition a pair of firing pins are mounted laterally in the frame, each pin being in alignment with its barrel and with the cartridge chamber registering therewith. Particularly important is that means for selectively striking one of the firing pins is carried by the hammer so that each cartridge receives the same impact.

DETAILED DESCRIPTION OF THE INVENTION

As will be apparent from the following description, by this invention a variable geometry hammer is provided in order directly to strike the preselected firing pin. As a result of this direct impact there is no difference in percussion between the two firing mechanisms. In addition the firing mechanism and the ejection system of this gun do not deviate from conventional design.

This will best be understood by reference to the accompanying drawing which shows a preferred embodiment of the invention.

FIG. 1 is an elevational view, partially in section, of the revolver of the invention.

Figure 4:
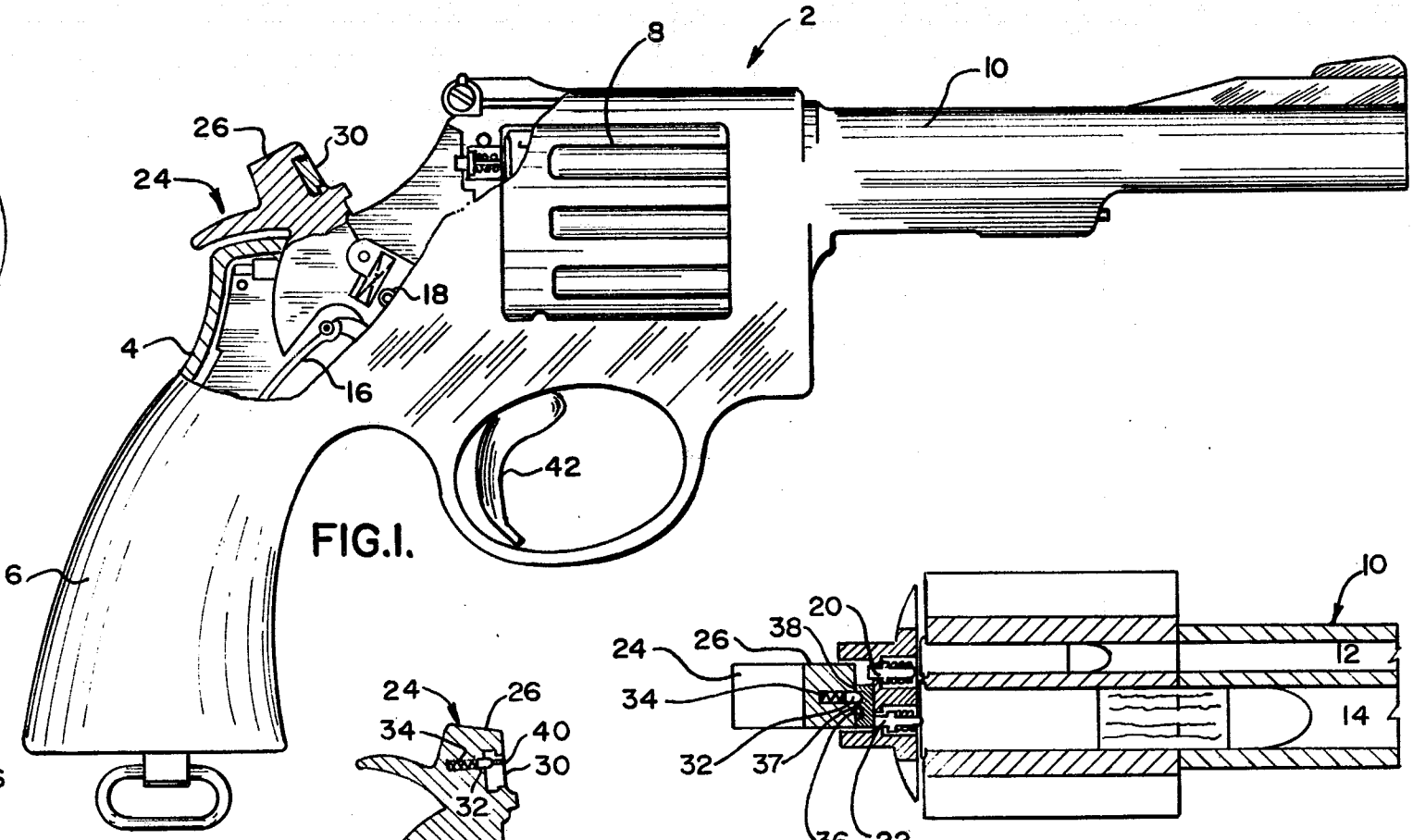
FIG. 4 is a cutaway cross sectional top view of the gun showing the firing pin assembly.

Referring now to FIG. 1 a revolver 2 is shown having a frame 4 carrying stock 6, cylinder 8, and double barrel 10. Barrel 10 is provided with adjacent bores 12 and 14 (FIG. 4). Small bore 12 is used for firing small caliber rim or center fire cartridges such as the .22 caliber magnum, long or short cartridges. Alongside of bore 12 is large bore 14 which will be made to fire .45, .38 or .357 cartridges.

One of the advantages of this invention is that, the firing mechanism and ejection system of a standard gun are not modified. In the preferred firing piece shown, a Smith & Wesson has been modified to fire two different size cartridges. Nevertheless mainspring 16, mechanism 18 and the remaining standard parts inside gun 2 have not been modified. The parts of the gun which have been modified are shown in FIGS. 2, 3, 4, and 5. These are the hammer, the barrel and the cylinder. And, of course, an additional firing pin is added.

Figure 2:
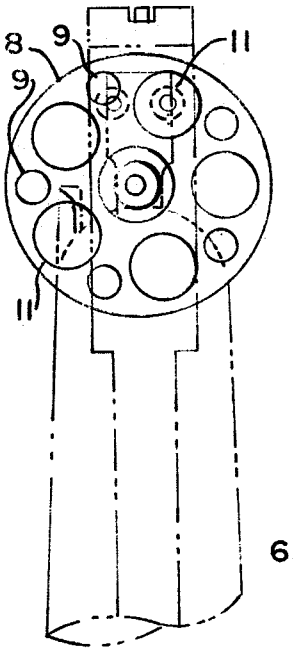
FIG. 2 is a rear view of the gun shown in FIG. 1.

The cylinder modification can be seen in FIG. 2. Cylinder 8 is provided with alternate small and large caliber chambers 9 and 11 which are in alignment with adjacent bores 12 and 14 in barrel 10. Whereas in some of the prior art firearms the hammer strikes the bullet directly, it is preferred herein to use firing pins, installed in the frame as shown in FIG. 4. The firing pins 20 and 22 are conventional firing pins of the type normally employed in a .22 caliber Smith & Wesson revolver, the only modification being the inclusion of an additional firing pin assembly hole.

Figure 5:
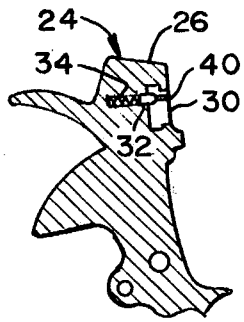
FIG. 5 is a cross sectional view of the gun hammer shown in FIG. 1.
Figure 3:
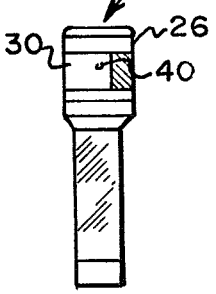
FIG. 3 is a front end view of the gun hammer of FIG. 1.

As indicated hereinbefore an important element of this invention is the variable geometry hammer 24. As can be seen in FIGS. 3 and 4, head 26 of hammer 24 is broader than the normal hammer head to provide a wider striking face. The breadth of hammer head 26 permits it to carry a slideable striker plate 30. Reference to FIGS. 1 and 5 shows that a keyway is provided in hammer head 26, striker plate 30 being slideable therein. To position the striker plate 30 and prevent it from sliding out of the keyway, pin 32 and spring 34 are disposed in a well in hammer head 26 as shown in FIG. 5. Pin 32, on being urged forward by spring 34 seats in recessed area 36 seen in FIG. 4. Two recessed areas or seats 36 are provided with a bridge 37 therebetween Rim 38 confines pin 32 to present striker plate 30 from sliding out the side of the keyway. If it is desired to move striker plate 30 from hammer head 26 a pin is inserted in hole 40 to depress pin 32 so that it will clear rim 38.

Considering now the operation of revolver 2, the hammer 24 is cocked and the cartridge selection is made by setting the striker plate. Depending upon whether the large or small cartridge is to be fired, striker plate 30 is moved to the left or right to seat pin 32 in appropriate seat 36. Thus, if the large caliber cartridge is fired as shown in FIG. 4 pin 32 is seated in left seat 36. When trigger 42 is pulled the striker plate does not strike small cartridge firing pin 20, but only large cartridge firing pin 22, detonating the larger caliber cartridge.

An advantage of the invention, thus, is that the gun handles, cocks, fires and ejects like any Smith & Wesson or Colt revolver, only the hammer being different. Another advantage of the invention is that for greater accuracy the gun barrel 10 is provided with bores 12 and 14 which are closely disposed side-by-side, rather than one a distance below the other. Tilting of the hand make less difference in hitting the target with this disposition of gun bores. Obviously the cylinder chambers and firing pins are aligned and indexed to register with their respective gun barrels. To accomplish this cylinder 8 is provided with two sizes of cartridge chambers 9 and 11 alternately, concentrically and adjacent arranged in order to align with the barrels as shown in FIG. 2.

Having been given the teachings of this invention variations will occur to those skilled in the art. As an example means for a cleaning rod can be provided beneath the gun barrel. Various types of firing pin assemblies can be employed, and firing mechanisms and ejector systems will depend upon the make of revolver modified in accordance with the invention. Such ramifications are deemed to be within the scope of this invention.

What is claimed is:

1. In a dual caliber revolver of the type having: (1) a frame, (2) two barrels attached thereto, (3) a means for supporting the two barrels so that one is beside the other, (4) a cylinder having the two sizes of cartridge chambers alternately concentrically arranged and adjacently aligned to register with their respective barrels, (5) a pair of firing pins mounted laterally in the frame, each pin being in alignment with its barrel and with the cartridge chamber registering therewith, and (6) means carried by the hammer for selectively striking one of the firing pins comprising (a) a firing pin striker plate, (b) keyway means rendering the striker plate slideable from one side of the hammer to the other, (c) pin means cooperating with recesses for locking said plate in position to strike one of the firing pins and to preventing it from sliding out of the keyway.

* * * * *